US010769937B2

(12) United States Patent
Barrieau et al.

(10) Patent No.: US 10,769,937 B2
(45) **Date of Patent: *Sep. 8, 2020**

(54) SYSTEM AND METHOD FOR CHARGING SUPPLEMENTAL POWER UNITS FOR ALARM NOTIFICATION DEVICES

(71) Applicant: Tyco Fire & Security GmbH, Neuhausen am Rheinfall (CH)

(72) Inventors: Mark P. Barrieau, Baldwinville, MA (US); Andreas Brenner, Hohenkirchen (DE)

(73) Assignee: JOHNSON CONTROLS FIRE PROTECTION LP, Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/990,125

(22) Filed: May 25, 2018

(65) Prior Publication Data

US 2018/0276982 A1 Sep. 27, 2018

Related U.S. Application Data

(63) Continuation of application No. 15/095,614, filed on Apr. 11, 2016, now Pat. No. 10,008,105.
(Continued)

(51) Int. Cl.
*G08B 29/18* (2006.01)
*G08B 17/06* (2006.01)
(Continued)

(52) U.S. Cl.
CPC ..... *G08B 29/181* (2013.01); *G08B 17/06* (2013.01); *G08B 29/145* (2013.01); *G08B 25/04* (2013.01)

(58) Field of Classification Search
CPC .. B60R 25/04; G05F 1/66; G08B 3/10; G08B 5/38; G08B 7/06; G08B 7/10;
(Continued)

(56) References Cited

U.S. PATENT DOCUMENTS 4,796,025 A 1/1989 Farley et al.
5,559,492 A 9/1996 Stewart et al.
(Continued)

FOREIGN PATENT DOCUMENTS

EP 1724737 11/2006
EP 2701132 2/2014
WO WO 03048796 6/2003

OTHER PUBLICATIONS

Extended European Search Report, dated Jan. 10, 2017, from European Application No. 16183884.2, filed on Aug. 11, 2016. Ten pages.

*Primary Examiner* — Stephen R Burgdorf
(74) *Attorney, Agent, or Firm* — HoustonHogle LLP

(57) ABSTRACT

A system and method for providing supplemental power to a notification unit of a device in a fire alarm system. The notification unit generates alert signals for indicating an alarm. The device includes a power unit for providing the supplemental power to the notification unit and a device controller for charging the power unit. The device controller charges the power unit in response to receiving a charging synchronization signal from a system controller of the system.

20 Claims, 11 Drawing Sheets

Related U.S. Application Data

(60) Provisional application No. 62/235,419, filed on Sep. 30, 2015.

(51) Int. Cl.
*G08B 29/14* (2006.01)
*G08B 25/04* (2006.01)

(58) Field of Classification Search
CPC ..... G08B 17/10; G08B 17/06; G08B 25/04; G08B 25/06; G08B 25/10; G08B 25/14; G08B 26/001; G08B 29/145; G08B 29/181; G08G 1/205; H02J 7/0068; H02J 9/061; H01M 10/44; Y02T 10/7005
USPC ..... 304/508
See application file for complete search history.

(56) References Cited

U.S. PATENT DOCUMENTS 5,650,762 A 7/1997 Takahashi et al.
5,966,002 A 10/1999 Barrieau et al.
6,281,789 B1 8/2001 Furtado et al.
6,426,697 B1 7/2002 Capowski et al.
7,024,469 B1 4/2006 Chang et al.
7,333,010 B2 2/2008 Barrieau et al.
7,400,226 B2 7/2008 Barrieau et al.
7,459,881 B2 12/2008 Barrieau
7,469,204 B2 12/2008 Brooks et al.
7,508,303 B2 3/2009 Capowski et al.
RE41,871 E 10/2010 Capowski et al.
8,773,276 B2 * 7/2014 Savage, Jr. ..... G08B 5/38 340/332
2003/0080865 A1 5/2003 Capowski et al.
2004/0263120 A1 12/2004 Kazecki et al.
2008/0001726 A1 1/2008 Stewart et al.
2009/0237239 A1 9/2009 McSheffrey
2013/0141245 A1 6/2013 Gadonniex et al.
2016/0071402 A1 * 3/2016 Chiarizio ..... G08B 27/008 340/539.17

* cited by examiner

SYSTEM AND METHOD FOR CHARGING SUPPLEMENTAL POWER UNITS FOR ALARM NOTIFICATION DEVICES

RELATED APPLICATIONS

This application is a Continuation of U.S. patent application Ser. No. 15/095,614, filed on Apr. 11, 2016, which claims the benefit under 35 USC 119(e) of U.S. Provisional Application No. 62/235,419, filed on Sep. 30, 2015. All of the afore-mentioned applications are incorporated herein by this reference in their entirety.

BACKGROUND OF THE INVENTION

Fire alarm systems are often installed within commercial, residential, or governmental buildings, for instance. Examples of these buildings include hospitals, warehouses, schools, hotels, shopping malls, commercial and governmental buildings, and casinos. The fire alarm systems monitor for an existence of fire conditions, such as smoke or heat, and alert occupants when the fire conditions are detected.

Fire alarm systems typically include notification appliance devices for alerting occupants of the potential fire. Notification appliance devices include notification units such as horns or strobes. The notification units generate alert signals (e.g., audible signals or visible signals) for indicating an alarm (i.e., potential fire) to occupants.

Fire alarm systems also include initiation devices that can detect fire conditions or be manually activated. One type of initiation device is a detector device that includes a sensor unit for detecting the existence of fire conditions (i.e., smoke or heat). The sensor unit can be a smoke sensor, a heat sensor, a flame sensor, or the like. Another type of initiation device is a notification/detector combination device that includes a notification unit and a smoke/heat sensor unit. Still another type of initiation device is a manually activated unit such as a fire alarm box/pull station. The fire alarm box/pull station can be manually actuated by pulling a handle and/or pushing a bar. For purposes of this discussion, a manually activated unit includes any device that is actuated by a human person. For example, devices designed to be actuated by a person who may not have use of their hands. (note: ADA compliant devices)

System controllers of the fire alarm systems monitor the initiation devices and activate the notification appliance devices. For example, when fire conditions (i.e., smoke or heat) are detected by the initiation devices (e.g., detector devices and notification/detector combination devices), the initiation devices send alarm signals to the system controller. The system controller responds to the alarm signals by activating the notification appliance devices to generate the alert signals to indicate an alarm (i.e., alert occupants of potential fire).

System networks connect the system controllers to the initiation devices and notification appliance devices. The system networks typically include at least one common pair of lines, also known as a loop. Several initiation devices and notification appliance devices can be wired to this common pair of lines that extend from the system controller. The system controller provides power to and communicates with the initiation devices and notification appliance devices on the common pair of lines. Typically, the system controller has a power source such as a DC power unit to supply power on the common pair of lines. This DC power unit supplies power at a fixed voltage and is limited to providing a maximum current.

The notification appliance devices have a communication mode and an activation mode. In the communication mode, the notification appliance devices perform basic operations such as communicating with the system controller (e.g., respond to group polling) while the notification units are kept inactive. In the activation mode, the notification units are activated (i.e., turned on) causing generating of the alert signals.

SUMMARY OF THE INVENTION

The notification appliance devices consume significantly more power when in the activation mode. In the communication mode, the notification appliance devices require enough power to provide basic operation of components in the notification appliance devices. When the notification appliance devices are in the activation mode, however, the notification appliance devices require additional power to run the notification units (e.g., turn on horn or turn on strobe).

Notification appliance devices that receive their power solely from the power source (e.g., DC power unit) of the system controller can encounter insufficient power problems when multiple notification appliance devices are activated. Also, this reliance on the fixed-size DC power unit can constrain the number of devices that can be installed on a loop while still ensuring that the power requirements of the activated notification appliance devices are met.

The present invention provides a solution to the above problems of insufficient power for devices on the system network. The present invention provides needed supplemental power for powering the devices on the system network. A power unit (e.g., power storage unit such as a storage battery or a supercapacitor) for the device can be used to provide this supplemental power. In one example, this power unit provides the supplemental power needed for activating a notification unit of a notification appliance device in activation mode. Preferably, the power unit is charged during charging phases when in the communications mode.

In general, according to one aspect, the invention features a device having a notification unit for generating alert signals that indicate an alarm, a power unit for providing supplemental power to the notification unit, and a device controller for charging the power unit in response to receiving a charging synchronization signal from a system controller. The power unit can be a supercapacitor or a rechargeable battery in examples. The device controller can monitor a state of charge of the power unit.

The device can further include a smoke/heat sensor unit or a manually activated unit for detecting a fire condition.

In an embodiment, the device can further include a power switch. The device controller directs the power switch to shift between providing the supplemental power to the notification unit and charging the power unit. The power switch can be a bipolar junction transistor (BJT), a field-effect transistor (FET), an insulated-gate bipolar transistor (IGBT), or a relay.

In an operational example, the device controller can direct the power switch to shift between a communication mode, a charging mode, and an activation mode in response to receiving a communication synchronization signal, the charging synchronization signal, and an alarm synchronization signal, respectively. The device controller sends data to and receives data from the system controller when the power switch is in the communication mode. The power unit is charged when the power switch is in the charging mode. The power unit provides the supplemental power to the notification unit when the power switch is in the activation mode.

In general, according to another aspect, the invention features an alarm system having a device for generating alert signals that indicate an alarm. The device includes a power unit for providing supplemental power to a notification unit and a device controller for charging the power unit. The alarm system also includes a system controller for controlling the device. The device controller charges the power unit in response to receiving a charging synchronization signal from the system controller. The device can be a notification appliance device or a notification/detector combination device. The system controller can be a control panel.

The alarm system can further include an energy harvesting unit for supplying additional power for charging the power unit. The energy harvesting unit is configured to harvest energy using an RF power receiver, an inductive coupling circuit, or a photovoltaic cell, for example.

In general, according to another aspect, the invention features a method for providing supplemental power to a notification unit of a device. The method includes a system controller sending a charging synchronization signal to the device. A device controller of the device charges a power unit in response to the device receiving the charging synchronization signal. The system controller sends an alarm synchronization signal to the device. The power unit provides supplemental power to the notification unit in response to the device receiving the alarm synchronization signal.

The method can further include the system controller sending a communication synchronization signal to the device. The device controller sends data to and receives data from the system controller after the device receives the communication synchronization signal.

The communication synchronization signal and the charging synchronization signal can be sent during a communication time period. The communication time period is divided between a polling time period and a charging time period.

The communication synchronization signal and the alarm synchronization signal can be sent during an alarm time period. The alarm time period is divided between an activation time period and a polling time period.

The device controller can direct a power switch to an open position in response to the device receiving the communication synchronization signal. The device controller can also direct the power switch to a closed position between the power unit and a power bus line in response to the device receiving the charging synchronization signal. Further, the device controller can direct the power switch to a closed position between the power unit and the notification unit in response to the device receiving the alarm synchronization signal.

The method can further include the system controller polling a group of devices for a status change where at least one device of the group of devices has the status change. The system controller polls a byte group of devices from the group of devices. Then, the system controller polls a nyble group of devices from the byte group of devices that responded to the byte group polling. Then, the system controller polls a two bit pair of devices from the nyble group of devices that responded to the nyble group polling. Then, the system controller polls a device of the two bit pair of devices.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

This invention may be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
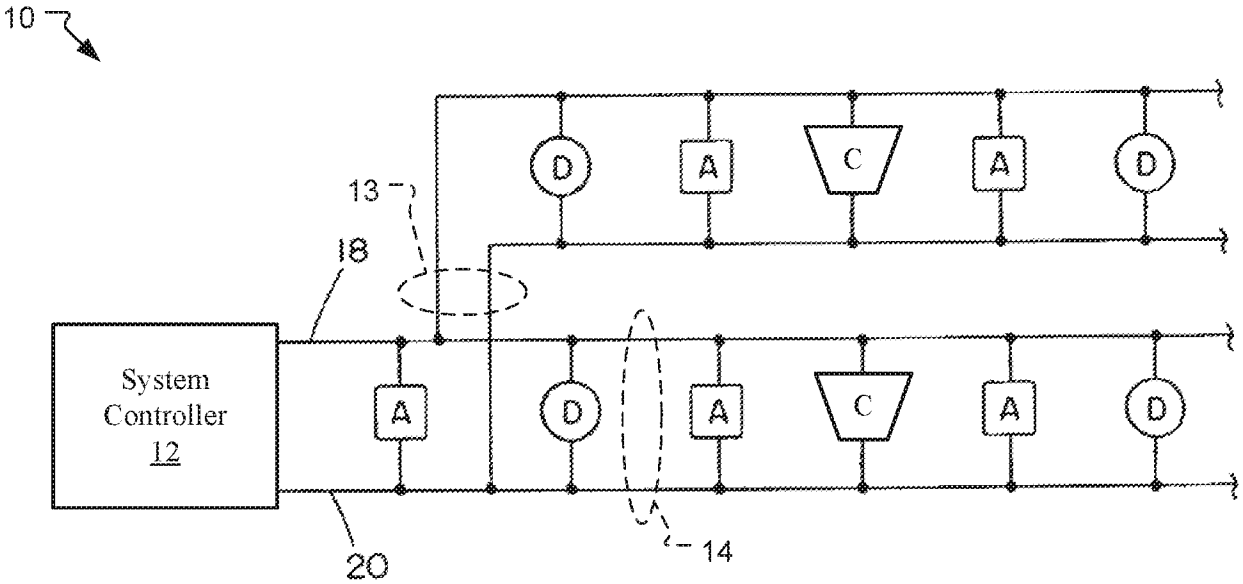
FIG. 1 is a schematic diagram of a fire alarm system including notification appliance devices, detector devices, and notification/detector combination devices.

FIG. 1 depicts a fire alarm system 10 including a system controller 12, also known as a control panel, monitoring initiation devices (detector devices D and notification/detector combination devices C) and activating notification appliance devices A. When fire conditions (i.e., smoke or heat) are detected by the initiation devices D, C, the initiation devices D, C send alarm signals to the system controller 12. The system controller 12 responds to the alarm signals by activating the notification appliance devices A to generate alert signals to indicate an alarm (i.e., alert occupants of a potential fire).

The system controller 12, the notification appliance devices A, and the initiation devices (detector devices D and notification/detector combination devices C) are connected to one another via a system network 14. The system network 14 typically includes a common pair of system lines 18, 20 also known as a loop. All of the devices A, D, C are connected to the system lines 18, 20. In the illustrated example, the fire alarm system 10 also includes a stub circuit 13 that extends off of the system lines 18, 20 for extending the system network 14. The system controller 12 provides system power to and communicates with the devices A, D, C via the system lines 18, 20. As appreciated by one of skill in the art, the fire alarm system 10 can include multiple system networks 14 (e.g., multiple common pairs of system lines 18, 20).

As appreciated by one of skill in the art, the fire alarm system 10 can include other devices such as auxiliary devices. The auxiliary devices can be door control devices, air handling unit control devices (exhaust fire floor, floor above fire, and floor below fire for example), devices for supplying extinguishing agent, and the like.

Figure 2A:
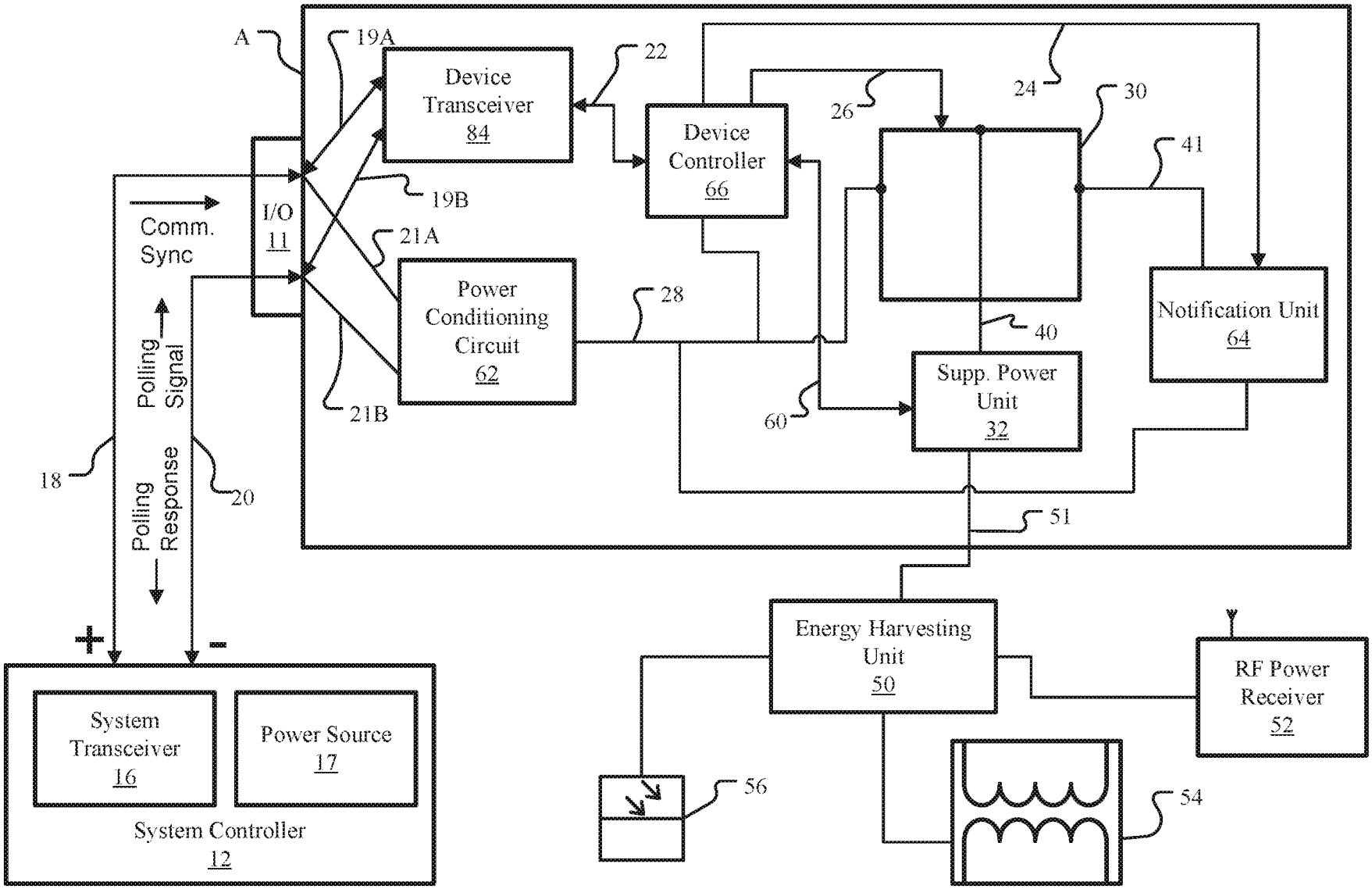
FIG. 2A is a detailed schematic view of a notification appliance device in a communication mode.
Figure 2B:
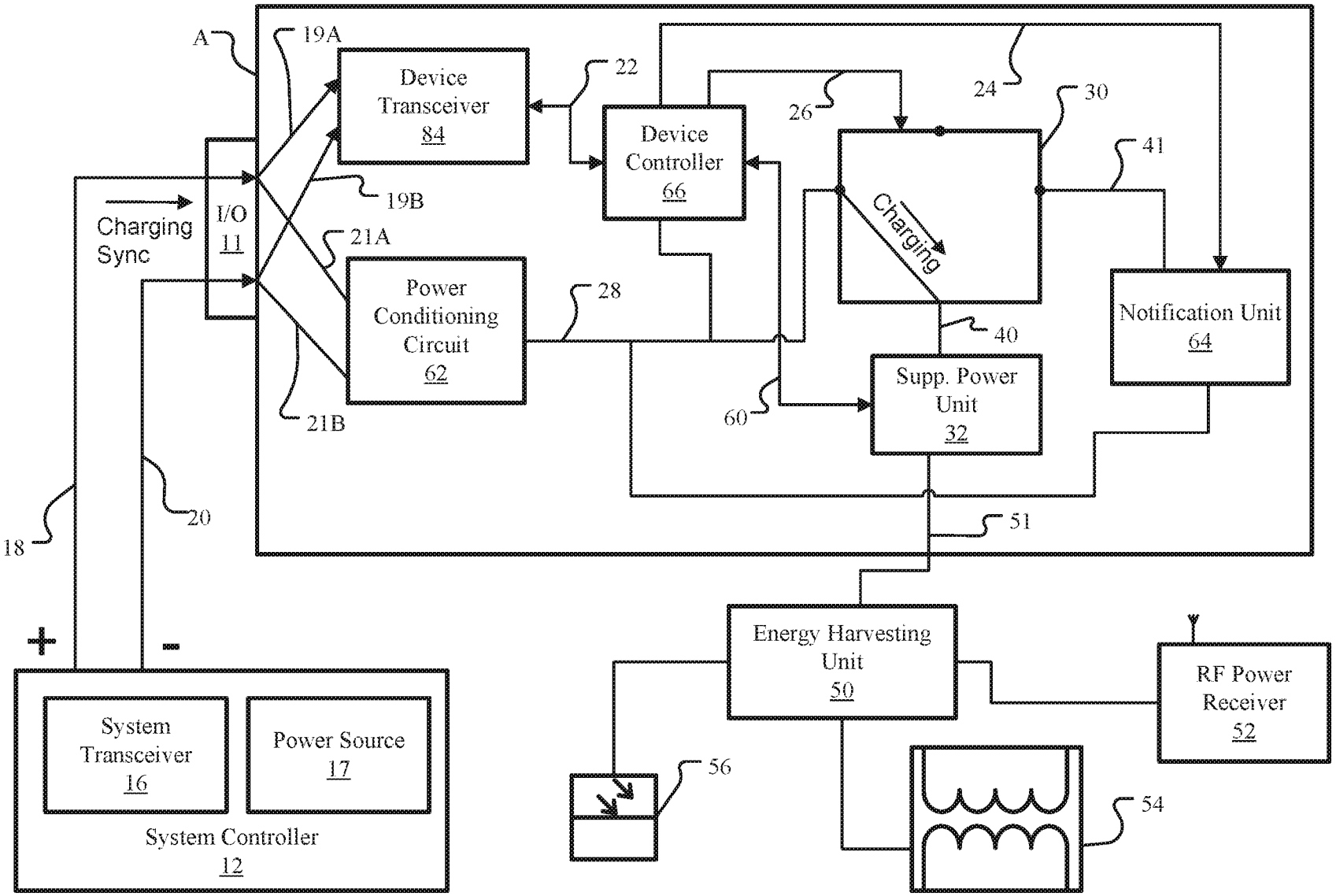
FIG. 2B is a detailed schematic view of the notification appliance device of FIG. 2A in a charging mode.
Figure 2C:
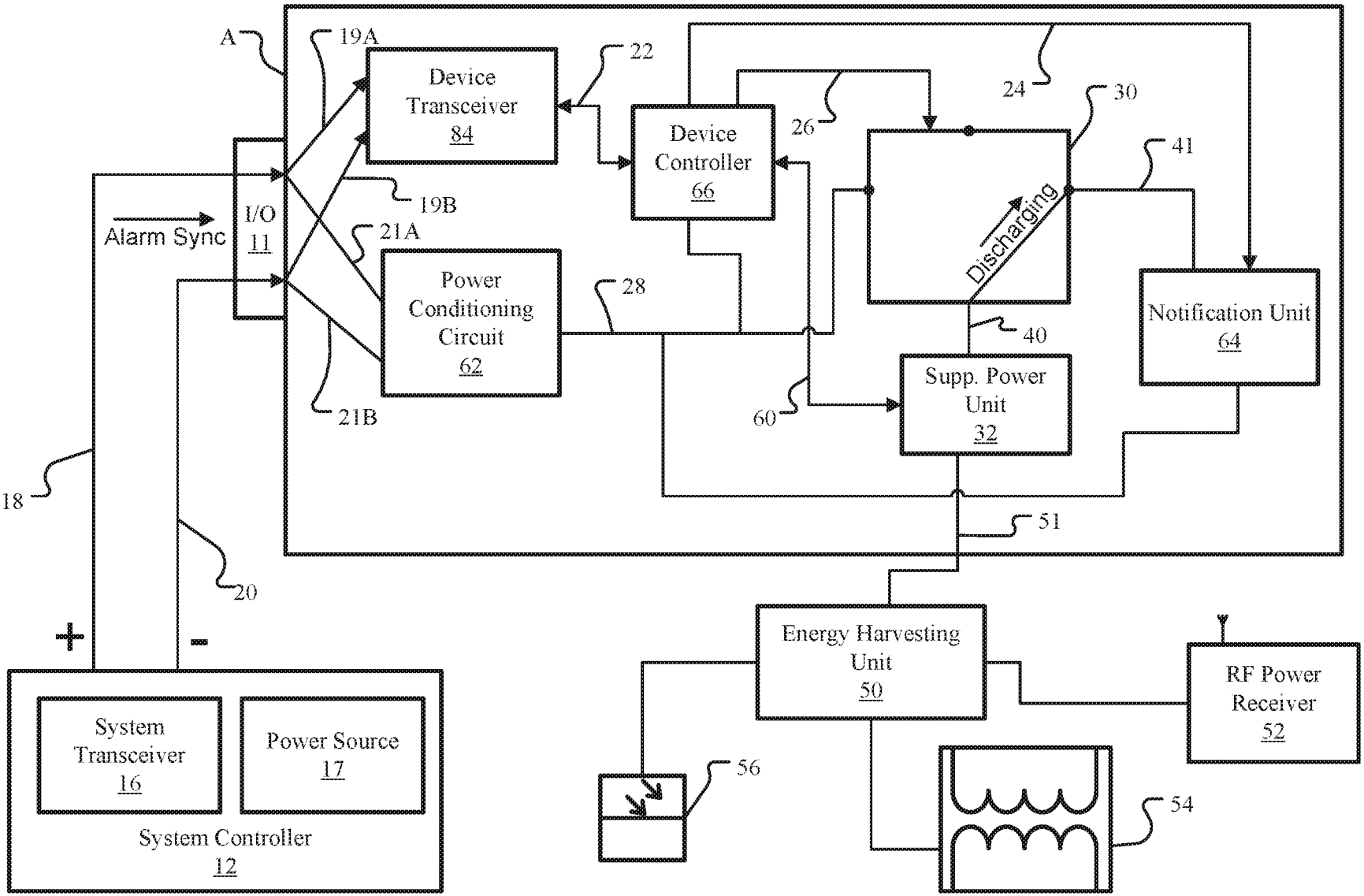
FIG. 2C is a detailed schematic view of the notification appliance device of FIG. 2A in an activation mode.

FIGS. 2A-2C schematically depict the internal components of the notification appliance device A. Some of the internal components include a notification unit 64, a supplemental power unit 32, a power switch 30, and a device controller 66.

The notification unit 64 alerts occupants of a potential fire. The notification unit 64 is often a horn, a strobe, or a combination audible/visible device. When activated, the notification unit 64 generates alert signals (e.g., audible signals for the horn or visible signals for the strobe) that indicate an alarm (i.e., potential fire) to occupants.

The supplemental power unit 32 provides supplemental power to the notification unit 64. The supplemental power unit 32 provides some of the power required to run the notification unit 64. The supplemental power unit 32 provides enough supplemental power to run the notification unit 64 (e.g., enough supplemental power to turn on strobe or turn on horn). In examples, the supplemental power unit 32 can be a power storage unit, such as a storage battery (e.g., rechargeable battery), a reserve battery (e.g., one-time use battery that is charged and then discharged until its power is exhausted), a supercapacitor, or the like. In one example, the supplemental power unit 32 is a 1 F, 2.7V supercapacitor with 200 mΩ series resistance. This supercapacitor has a discharge rate of 10 mA and can be charged in 45 minutes. This supercapacitor can discharge in 5 minutes at a discharge rate of 6 mA.

The power switch 30 shifts between charging the supplemental power unit 32 and providing the supplemental power to the notification unit 64. In one position, as illustrated in FIG. 2B, the power switch 30 charges the supplemental power unit 32 (i.e., replenish its power capacity) by directing current to the supplemental power unit 32 via a charging line 40. The supplemental power unit 32 can include a fault indicator that becomes active if the supplemental power unit 32 is not fully charged. In another position, as illustrated in FIG. 2C, the power switch 30 provides the supplemental power to the notification unit 64 by directing current (from the supplemental power unit 32) to the notification unit 64 via a discharging line 41. In examples, the power switch 30 is a bipolar junction transistor (BJT), a field-effect transistor (FET), an insulated-gate bipolar transistor (IGBT), a relay, or the like.

The device controller 66 directs the power switch 30 and instructs the notification unit 64 to activate. The device controller 66 directs the power switch 30 (via a switch control line 26) to shift between charging the supplemental power unit 32 and providing the supplemental power to the notification unit 64. In one implementation, the device controller 66 monitors a state of charge of the supplemental power unit 32 via connection 60 and: 1) directs the power switch 30 to terminate charging of the supplemental power unit 32 when it is fully charged; and 2) directs the power switch 30 to restart charging of the supplemental power unit 32 when the device controller 66 determines that the supplemental power unit 32 should be recharged. The device controller 66 also instructs the notification unit 64 (e.g., sending control signals via a notification control line 24) to activate when the supplemental power unit 32 is providing the supplemental power. The device controller 66 directs the power switch 30 and instructs the notification unit 64 based on communications received from the system controller 12. The device controller 66 can be a microcontroller, an application-specific integrated circuit (ASIC) controller, or the like.

The notification appliance device A uses an input/output network interface 11 for connecting to the system lines 18, 20 and receiving system power for powering its internal components. The input/output network interface 11 receives the system power from system lines 18, 20 and then forwards the system power to a power conditioning circuit 62 via device power lines 21A, B. The power conditioning circuit 62 conditions the voltage and current to levels that are acceptable for the internal components of the notification appliance device A. The power conditioning circuit 62 then provides a constant voltage to a power bus line 28 that distributes power to the device controller 66, the power switch 30, and the notification unit 64 (i.e., internal components). As described above, the power switch 30 can charge the supplemental power unit 32 by directing power from the power bus line 28 to the supplemental power unit 32 (i.e., supplemental power unit 32 draws current at a high rate from power bus line 28 until it is fully recharged). The notification unit 64 consumes power from the power bus line 28 for operating its basic functions and/or during activation.

The notification appliance device A receives additional power from an energy harvesting unit 50 for charging the supplemental power unit 32 in some embodiments. The energy harvesting unit 50 can harvest energy from an environment in the vicinity of the notification appliance device A. For example, the energy harvesting unit 50 can harvest energy via a radio frequency (RF) power receiver 52, an inductive coupling circuit 54, and/or a photovoltaic cell 56 (i.e., solar panel), for example. The energy harvesting unit 50 provides the harvested energy to the supplemental power unit 32 via a harvest power line 51, as needed, for charging the supplemental power unit 32. For example, the photovoltaic cell 56 produces energy over time during the day while building lights are on. This energy could be used to charge the supplemental power unit 32.

The notification appliance device A also uses the input/output network interface 11 for sending/receiving communications via the system network 22 via a device transceiver 84 along input/output communication lines 19A, B. The device transceiver 84 transmits and receives communications to and from the device controller 66 along a transceiver-controller line 22. The device transceiver 84 can detect and decode communications (e.g., control signals or polling signals) received from the system controller 12 in order to differentiate between different types of communication. The device transceiver 84 translates the decoded communications to an appropriate format for the device controller 66. The device transceiver 84 also translates communications received from the device controller 66 to an appropriate format for the system network 22 (e.g., translate digital data streams to a proper protocol for network 14).

The main components of the system controller 12 include a system transceiver 16 and a power source 17.

The system controller 12 uses the power source 17 to provide the system power on the system lines 18, 20. The power source 17 can be a DC power unit that also includes battery back-up. The DC power unit supplies power at a fixed voltage and is limited to providing a maximum current.

The system controller 12 uses the system transceiver 16 to communicate with the devices D, C, A on the system lines 18, 20. The system transceiver 16 transmits communication (e.g., different types of control signals) to the notification appliance device A. For example, the system transceiver 16 can include a signal generator for generating different control signals by changing the polarity of the control signals (e.g., adjusting voltage on the positive system line 18 or adjusting voltage on the negative system line 20 generates different current pulses). The system transceiver 16 also receives and decodes communications from the notification appliance device A via system lines 18, 20.

The system controller 12 can use an addressable communication protocol for providing communication with devices A, D, C on the system lines 18, 20. The addressable communication protocol (also called signaling line circuit (SLC)) can be Multi-Application Peripheral Network (MAPNET) II, Individual Device Network (IDNET), or the like. The system controller 12 can include a transmission addressable circuit in the system transceiver 16 for communicating according to these addressable communication protocols. The notification appliance device A can include a receiving addressable circuit in the device transceiver 84 for communicating according to these addressable communication protocols. Devices utilizing these addressable communication protocols can be termed "Special Application Devices".

In FIG. 2A, the notification appliance device A is operating in a communication mode. The system controller 12 initiates the communication mode by sending a communication synchronization signal to the notification appliance device A via the system lines 18, 20. In response, the device controller 66 of the notification appliance device A directs the power switch 30 to shift to an open position which deactivates the supplemental power unit 32. During the communication mode, the notification appliance device A performs basic operations such as communicating and monitoring (i.e., sending and receiving data) with the system controller 12 while the supplemental power unit 32 is kept inactive. For example, the system controller 12 can initiate group polling during the communication mode (i.e., system controller 12 sends a polling signal and the notification appliance device A replies with a polling response signal indicating its status).

In FIG. 2B, the notification appliance device A is operating in a charging mode. The system controller 12 initiates the charging mode by sending a charging synchronization signal to the notification appliance device A via the system lines 18, 20. In response, the device controller 66 of the notification appliance device A directs the power switch 30 to shift to a closed position between the supplemental power unit 32 and the power bus line 28. As a result, the power switch 30 charges the supplemental power unit 32 via the charging line 40. The supplemental power unit 32 is charged at a relatively slow rate limited by the power bus line 28 and the system lines 18, 20. For example, the supplemental power unit 32 is a supercapacitor that consumes about one or two milliamps from the power bus line 28 over a long period of time, storing enough energy to power the notification unit 64 (e.g., sounder) for 5 minutes.

In FIG. 2C, the notification appliance device A is operating in an activation mode. The system controller 12 initiates the activation mode by sending an alarm synchronization signal to the notification appliance A via the system lines 18, 20. In response, the device controller 66 of the notification appliance device A directs the power switch 30 to a closed position between the supplemental power unit 32 and the notification unit 64. This causes the supplemental power unit 32 to discharge its supplemental power to the notification unit 64 via the discharging line 41. The device controller 12 also sends an activation control signal to the notification unit 64 via the notification control line 24. As a result, the notification unit 64 is activated and generates alert signals (e.g., audible signals or visible signals). In one example, the notification unit 64 is provided a total of 3 A or more of DC current during the activation mode.

Figure 3:
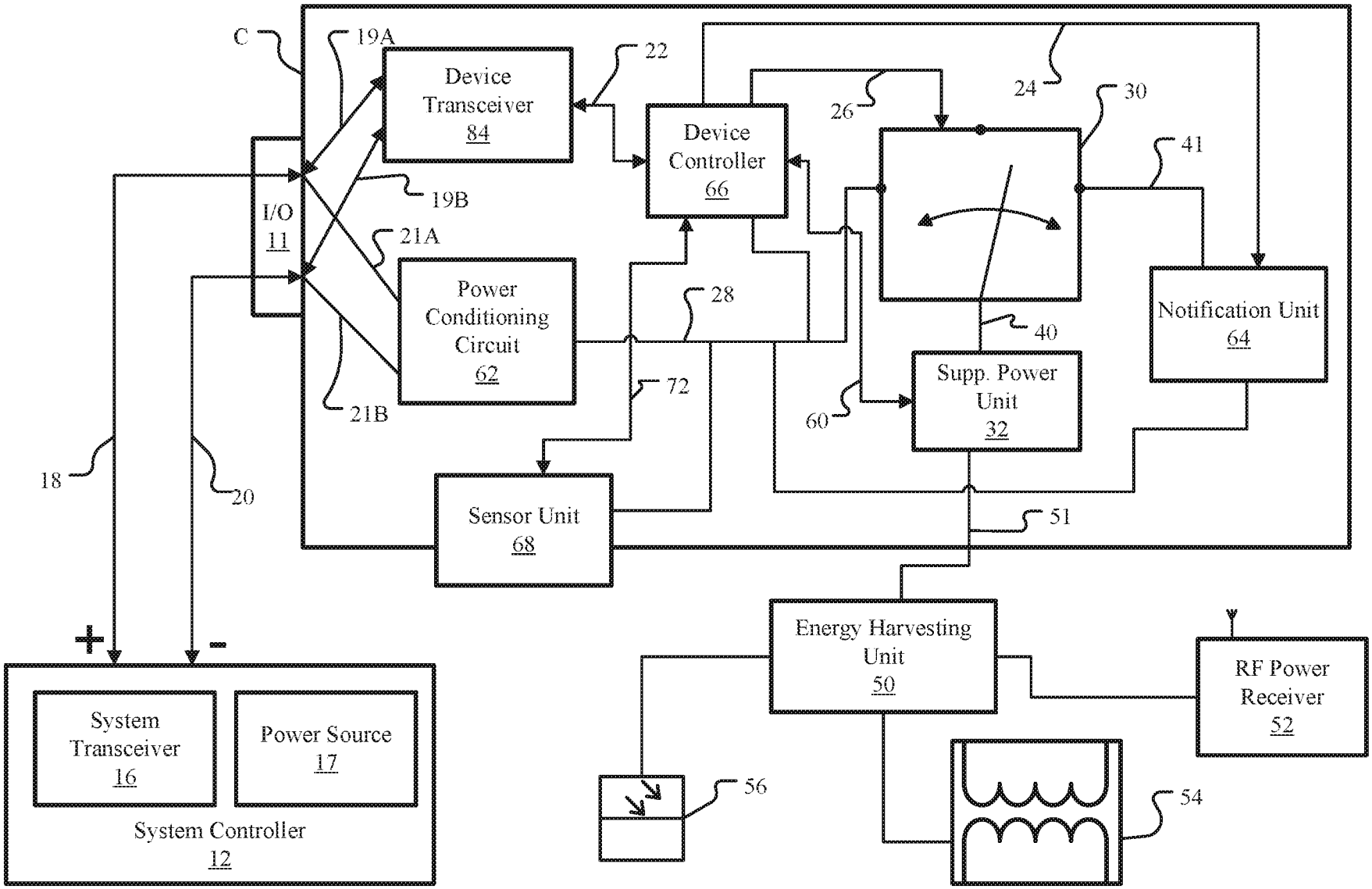
FIG. 3 is a detailed schematic view of a notification/detector combination device.

As illustrated in FIG. 3, the notification/detector combination device C is nearly identical to the notification appliance device A except the notification/detector combination device C further includes a sensor unit 68. However, in other embodiments, the sensor unit 68 is replaced with a manually activated unit. The sensor unit 68 detects for the existence of fire conditions such as smoke or heat or otherwise. The sensor unit 68 can be a smoke sensor, a heat sensor, a flame sensor, or the like. This sensor unit 68 continuously operates from power received on the power bus line 28 during the communication mode, the charging mode, and the activation mode. The sensor unit 68 sends detection data (i.e., measurements of heat or smoke) to the device controller 66 via a detection line 72. The device controller 66 determines whether the detection data indicates fire conditions. If fire conditions are indicated, the notification/detector combination device C sends alarms signals to the system controller 12. The notification/detector combination device C can shift into the activation mode without receiving the alarm synchronization signal when the notification/detector combination device C detects the fire conditions. Alternatively, when fire conditions are detected by another initiation device C, D, the notification/detector combination device C can shift into activation mode after receiving the alarm synchronization signal from the system controller 12. As described above, the supplemental power unit 32 discharges its supplemental power to the notification unit 64 via the discharging line 41 during the activation mode. Similar to the notification appliance device A, the notification/detector combination device C operates in the communication mode only after receiving the communication synchronization signal and operates in the charging mode only after receiving the charging synchronization signal.

Figure 4:
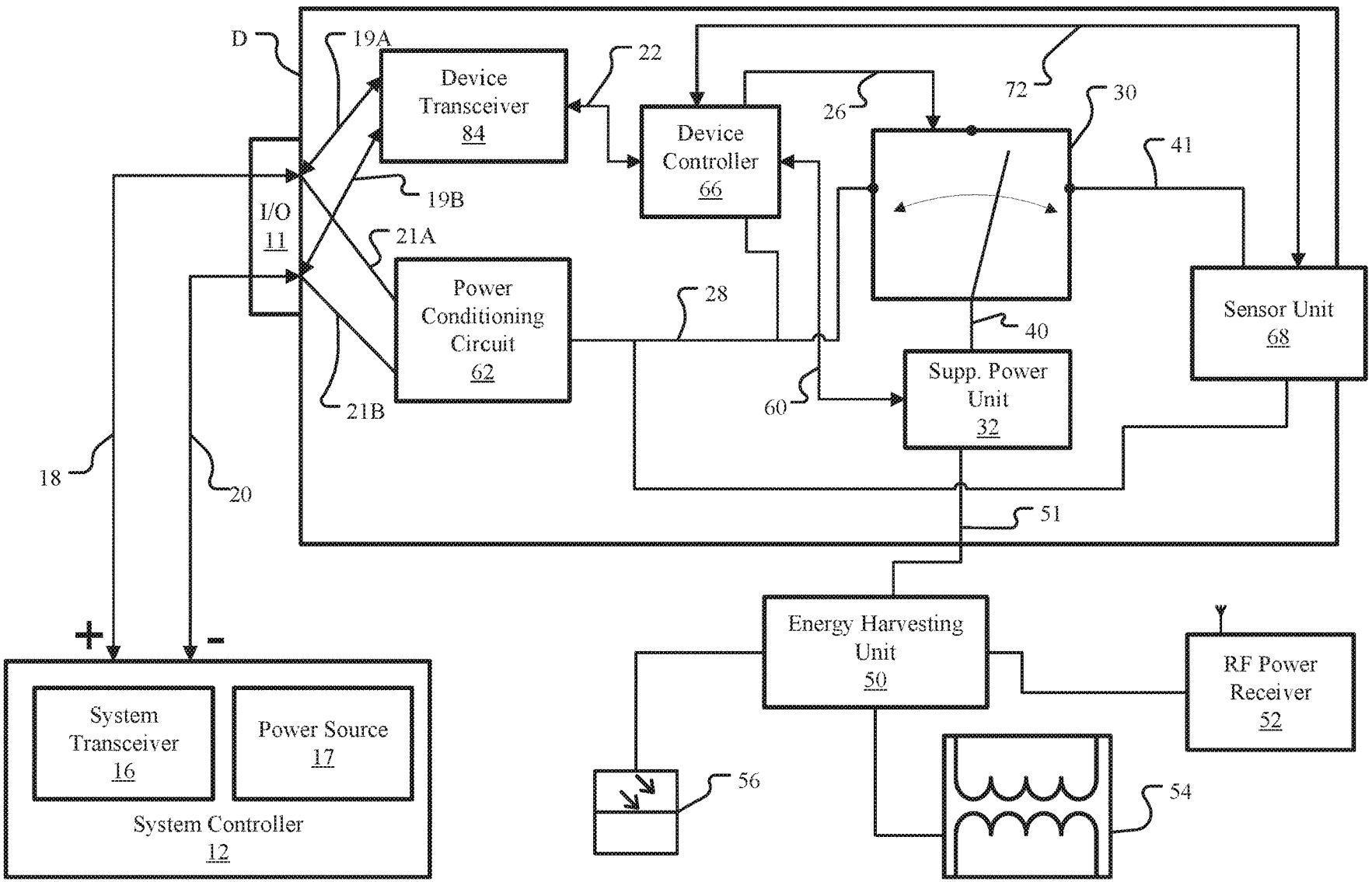
FIG. 4 is a detailed schematic view of a detector device.

As illustrated in FIG. 4, the detector device D is nearly identical to the notification/detector combination device C except the notification unit 64 is removed and the supplemental power unit 32 is used to provide supplemental power to the sensor unit 68. Similar to the notification/detector combination device C, the sensor unit 68 of the detector device D continuously operates from power received on the power bus line 28 during the communication mode, the charging mode, and the activation mode. For the detector device D, the sensor unit 68 receives supplemental power from the supplemental power unit 32 during the activation mode. In one example, the detector device D uses the device controller 66 to monitor power at the sensor unit 68 (e.g., determine whether additional power is needed). When the device controller 66 indicates that additional power is needed, the detector device D shifts into the activation mode. Specifically, the detector device D uses the device controller 66 to direct the power switch 30 to shift to a closed position between the supplemental power unit 32 and the sensor unit 68. As a result, the supplemental power unit 32 discharges its supplemental power to the sensor unit 68 via the discharging line 41. The detector device D can use the device controller 66 to shift between the activation mode, the communication mode, and the charging mode based on monitoring of power at the sensor unit 68. In another example, the system controller 12 monitors the system power at the detector device D. Based on this monitoring, the system controller 12 can direct the detector device D to shift between the activation mode, the communication mode, and the charging mode by sending the communication synchronization signal, the charging synchronization signal, and the alarm synchronization signal, respectively.

Figure 5:
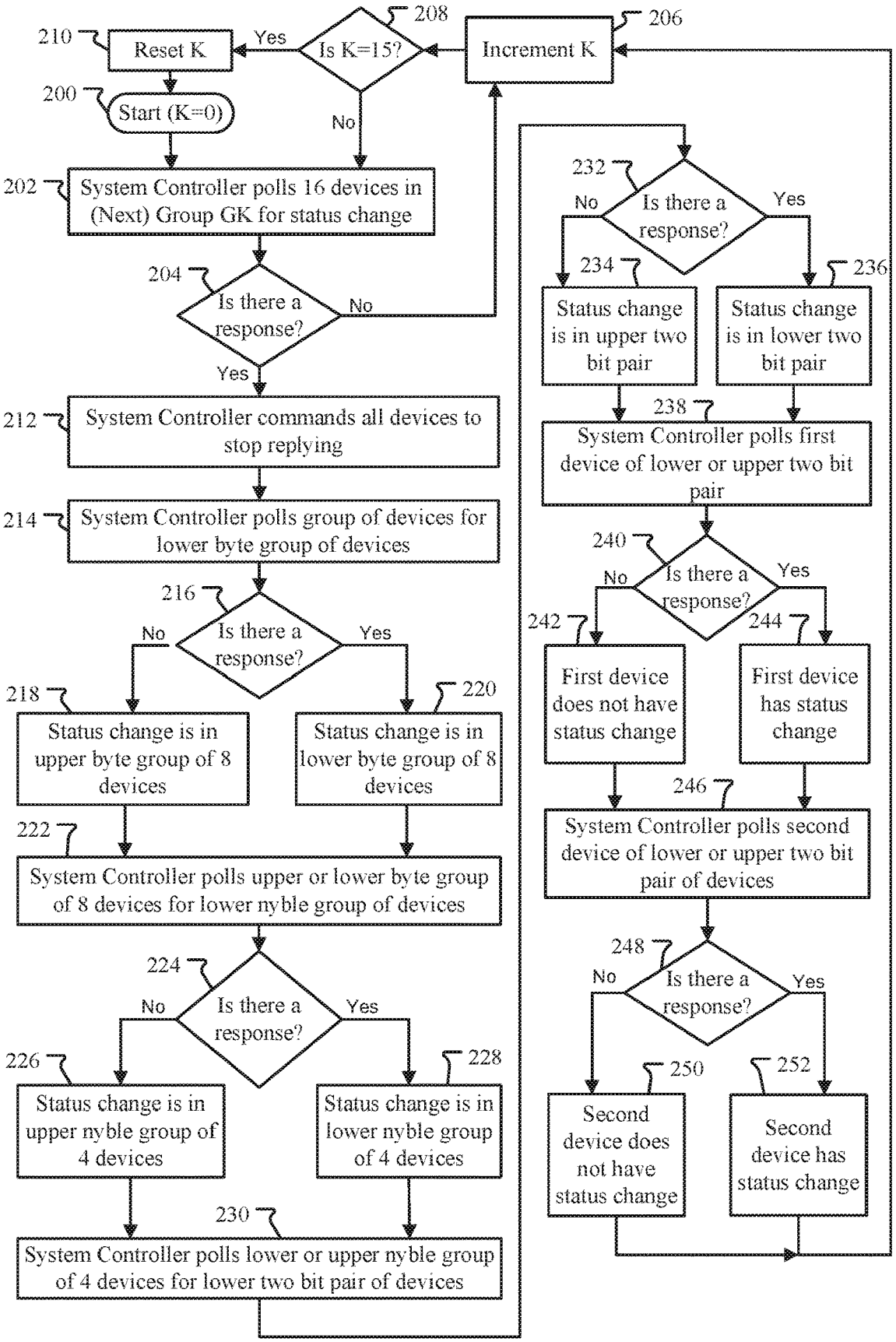
FIG. 5 is a flow chart of a polling scheme for 16 groups of 16 devices.

The polling scheme illustrated in FIG. 5 improves the speed and efficiency of group polling by determining which devices A, D, C have a status change without having to individually poll each device A, D, C in the fire alarm system 10. This polling scheme revises previous polling protocol (e.g., poll 32 groups of 8 devices) to polling 16 groups of 16 devices. For example, where only one device per group has a status change, this revised polling scheme results in 6 polls for each group of 16 devices compared to 10 polls for each group of 16 devices based on the previous polling protocol (i.e., resulting in 60% decrease in polling). This change to the polling protocol reduces the traffic necessary to group poll (e.g., ~50% traffic reduction). Specifically, this is a reduction in the number of polls required for proper supervision of the devices A, D, C while still providing equal or better response to existing protocol. As a result, time that was previously spent on group polling is now available for use with other operations such as charging the supplemental power unit 32 or activation of the notification unit 64. Also, the reduced traffic causes a decrease in bandwidth requirements for the system network 14 (i.e., less total demand of the system power).

The polling scheme is a process of polling 16 groups of 16 devices A, D, C. The devices A, D, C only reply to group polling when they have a status change to report. The usual state for devices A, D, C receiving the group polling is no response. Thus, for previous polling protocol, many polls are sent with no responses. With the proposed polling scheme, the system controller 12 can advance through the group polling process in half the time or less compared to previous polling protocol by sending less polls.

In step 200, the polling scheme process is started with K=0. The system controller 12 then polls the first group of devices G0 for a status change (step 202). The system controller sets an address bit for only the first group of devices G0 such that only the devices in this first group of devices G0 receive the group poll. The system controller 12 determines if any of the devices in group G0 respond (step 204). If no devices respond, K is incremented in step 206. If there is a response by at least one of the devices (e.g., one device reports a status change), the system controller 12 commands all devices to stop replying in step 212. Then, the system controller 12 begins the process of determining which device has a status change to report.

In step 214, the system controller 12 polls the group of devices G0 for a lower byte group of devices. Then, the system controller 12 determines whether there is a response to polling for the lower byte group of devices in step 216. If no response is received, the system controller 12 determines that the status change is in upper byte group of 8 devices (step 218). If a response is received, the system controller 12 determines that the status change is in lower byte group of 8 devices (step 220). Alternatively, the system controller 12 can poll the group of devices G0 for the upper byte group of devices in step 214 and then determine whether there is a response to polling for the upper byte group of devices in step 216. When polling for the upper byte group of devices, steps 218 and 220 are reversed such that no response means that the status change is in the lower byte group of devices and a response means that the status change is in the upper byte group of devices.

After step 218 or step 220, the system controller 12 polls the upper or lower byte group of devices for a lower nyble group of devices (step 222). In step 224, the system controller 12 determines whether there is a response to the polling for the lower nyble group of devices. If no response is received, the system controller 12 determines that the status change is in the upper nyble group of 4 devices (step 226). If a response is received, the system controller 12 determines that the status change is in the lower nyble group of 4 devices (step 228). Alternatively, the system controller 12 can poll the upper or lower byte group of devices for the upper nyble group of devices in step 222 and then determine whether there is a response to polling for the upper nyble group of devices in step 224. When polling for the upper nyble group of devices, steps 222 and 224 are reversed such that no response means that the status change is in the lower nyble group of devices and a response means that the status change is in the upper nyble group of devices.

After step 226 or step 228, the system controller 12 polls the lower or upper nyble group of devices for a lower two bit pair of devices (step 230). In step 232, the system controller 12 determines whether there is a response to the polling for the lower two bit pair of devices. If no response, the system controller 12 determines that the status change is in the upper two bit pair devices (step 234). If there is a response, the system controller 12 determines that the status change is in the lower two bit pair devices (step 236). Alternatively, the system controller 12 can poll the lower or upper nyble group of devices for the upper two bit pair of devices in step 230 and then determine whether there is a response to polling for the upper two bit pair of devices in step 232. When polling for the upper two bit pair of devices, steps 234 and 236 are reversed such that no response means that the status change is in the lower two bit pair of devices and a response means that the status change is in the upper two bit pair of devices.

After step 234 or step 236, the system controller 12 polls a first device of the lower or upper two bit pair (step 238). In step 240, the system controller 12 determines whether there is a response to the polling for the first device. If no response, the system controller 12 determines that the first device does not have the status change (step 242). If there is a response, the system controller 12 determines that first device does have the status change (step 244). After step 242 or step 244, the system controller 12 polls a second device of the lower or upper two bit pair (step 238). If no response, the system controller 12 determines that the second device does not have the status change (step 250). If there is a response, the system controller 12 determines that the first device has the status change (step 252).

After step 250 or step 252, K is incremented in step 206. After K is incremented, the system controller 12 determines whether K=15 in step 208. If K does not equal 15 (i.e., K<15), the polling scheme process is repeated at step 202. If K does equal 15 (i.e., G15 has been polled), K is reset to 0 (step 210) and then the polling scheme process is repeated at step 200.

As appreciated by one of skill in the art, the polling scheme described above can be applied to other group formations such as 8 groups of 32 devices or 4 groups of 64 devices. These other group formations can decrease the number of group polls thus further reducing traffic. For example, 8 groups of 32 devices can result in only 8 group polls per ½ second. As a result, ¾ of the time typically spent on group polling is available for other operations.

Figure 6:
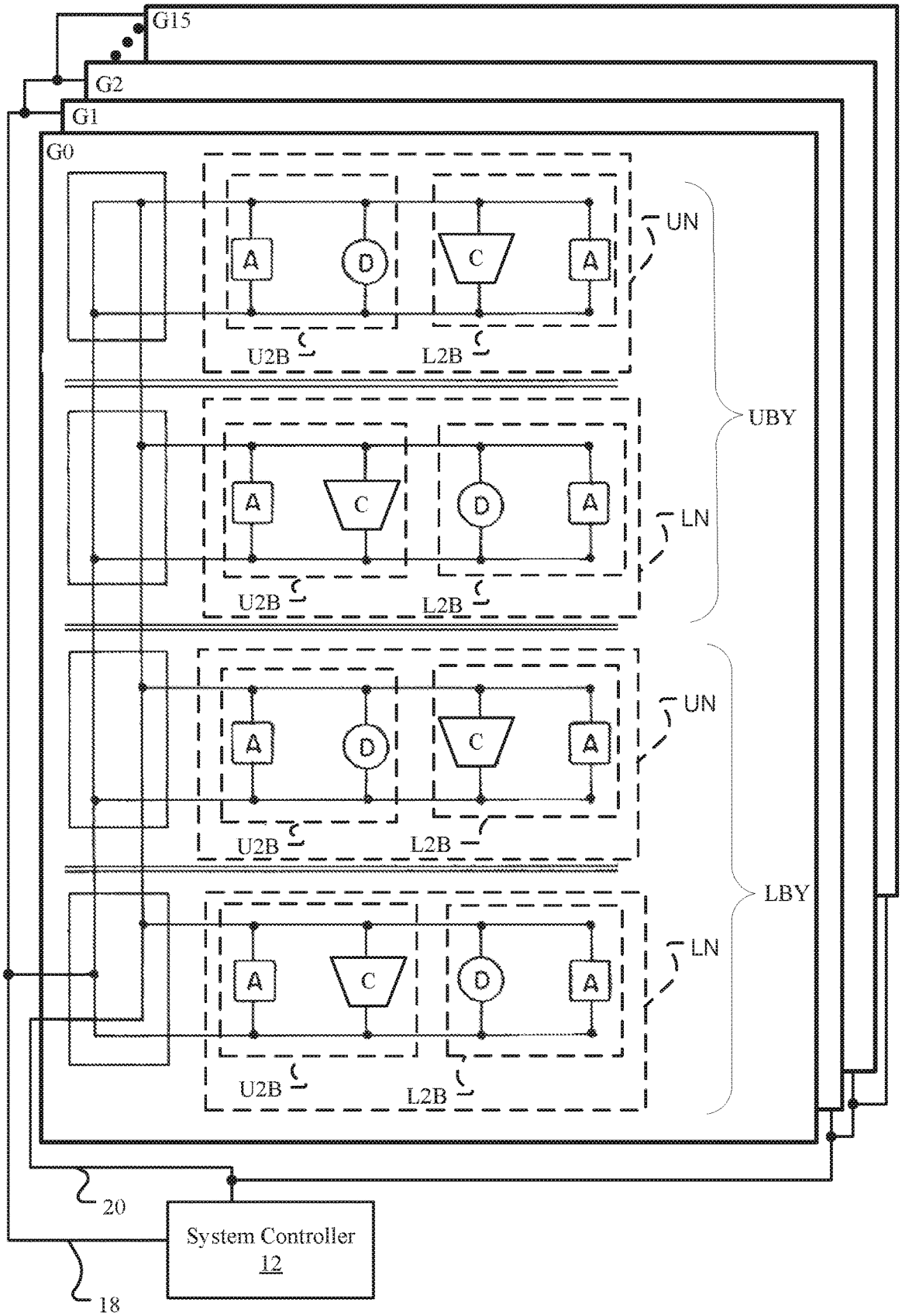
FIG. 6 shows 16 groups of 16 devices installed in a building.

FIG. 6 illustrates the grouping scheme (16 groups of 16 devices) described in the flow chart in FIG. 5. As shown in FIG. 6, there are 16 groups of devices G0 thru G15. Each group of devices (e.g., G0, G1, G2, . . . or G15) includes 16 devices A, D, C that are connected to the system controller 12 via the common pair of system lines 18, 20. Each group of devices (e.g., G0, G1, G2, . . . or G15) includes an upper byte group of devices UBY (8 devices) and a lower byte group of devices LBY (8 devices). Each byte group of devices UBY, LBY (upper or lower) includes an upper nyble group of devices UN (4 devices) and a lower nyble group of devices LN (4 devices). Each nyble group of devices UN, LN (upper or lower) includes an upper two-bit pair of devices U2B (2 devices) and a lower two-bit pair of devices L2B (2 devices).

As appreciated by one of skill in the art, the polling scheme described in FIGS. 5 and 6 may be applied to other numbers of groups. For example, instead of the grouping scheme including 16 groups of 16 devices, the grouping scheme can include other numbers of groups such as 32 groups of 8 devices, 8 groups of 32 devices, or 4 groups of 64 devices. Changing 16 groups of 16 devices to 8 groups of 32 devices results in only 8 group polls per ½ second, in one example. This results in a proportion, such as ¾, of the time typically spent on group polling to be available for other operations such as storing power. In general, the hardware design of the system controller 12 should account for the possibility of a large number of devices simultaneously answering a group poll.

As appreciated by one of skill in the art, the polling scheme described in FIGS. 5 and 6 may be applied to other formations of groups. For example, each group of devices (e.g., G0, G1, G2, . . . or G15) includes one type of device. For this example, G0 would only include notification appliance devices A, G1 would only include detector devices D, G3 would only include notification/detector combination devices C, etc. In another example, each group of devices (e.g., G0, G1, G2, . . . or G15) would either include initiation devices (detector devices D and notification/detector combination devices C) or notification appliance devices A. In another example, devices would be split up into different groups of devices based on their response frequency to group polling. These examples improve the efficiency of group polling since some types of devices require more or less frequent group polling than other types of devices.

Another protocol change that reduces group polling (e.g., decrease in responses to group polls) is the addition of "smart features" to the devices A, D, C. For example, some devices, such as an Analog Monitor Zone (AMZ), generate extreme traffic because slight changes that are to be expected can generate responses to group polls (e.g., thermometer constantly toggles with 1/10 degree changes). Another example candidate device is a heat detector. The addition of "smart features" to the AMZ, the heat detector, or other devices, can include redesigning temp monitors so that they do not signal as much (e.g., redesigning sensitivity to changes) which reduces the number of group polling responses.

Figure 7:
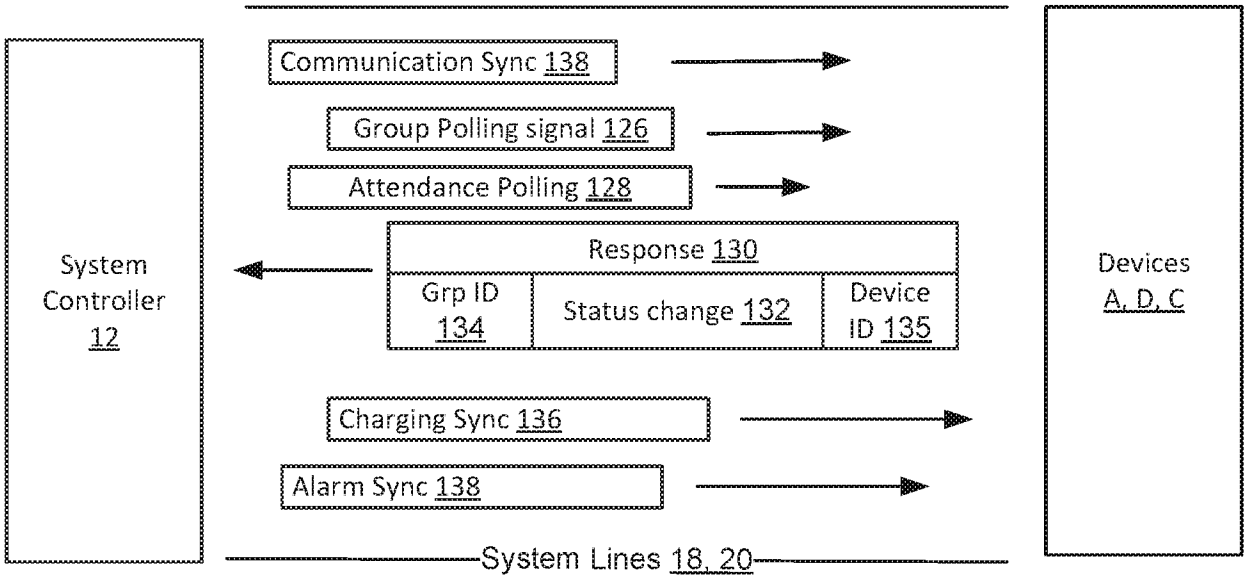
FIG. 7 is a schematic diagram illustrating the types of information exchanged between a system controller and devices.

FIG. 7 is a schematic diagram illustrating the types of information exchanged between the system controller 12 and the devices A, D, C via the system lines 18, 20. The system controller 12 sends the communication synchronization signal 138 to the devices A, D, C causing the devices A, D, C to operate in communication mode. During the communication mode, the system controller 12 typically sends polling signals such as a group polling signal 126 (i.e., group polling) and an attendance polling signal 128 (i.e., attendance polling) to the devices A, D, C. The attendance polling is used to determine if a device A, D, C is missing from the system lines 18, 20. For example, the attendance polling provides supervision of the system lines 18, 20 (i.e., loop) such that any missing device A, D, C would be detected within a period required by agency standard (e.g., 90 seconds). The group polling is used to determine whether any of the devices A, D, C have status changes. In response to the polling signals 126, 128, each device A, D, C sends a polling response 130 to the system controller 12. The polling response 130 includes a group ID 134 (e.g., corresponding to a particular group of devices G0, G1, G2, . . . or G15), a status change 132 (e.g., information on status of device), and a device ID (e.g., unique identification for each device). The polling response 130 for each detector device D and each notification/detector combination device C can include the detection data (e.g., analog value) from the sensor unit 68. The system controller 12 sends the charging synchronization signal 136 to the devices A, D, C causing the devices A, D, C to operate in the charging mode (i.e., charge supplemental power unit 32). The system controller 12 sends the alarm synchronization signal 138 to the devices A, D, C causing the devices A, D, C to operate in the activation mode (e.g., provide supplemental power to the notification unit 64 or the sensor unit 68).

Figure 8A:
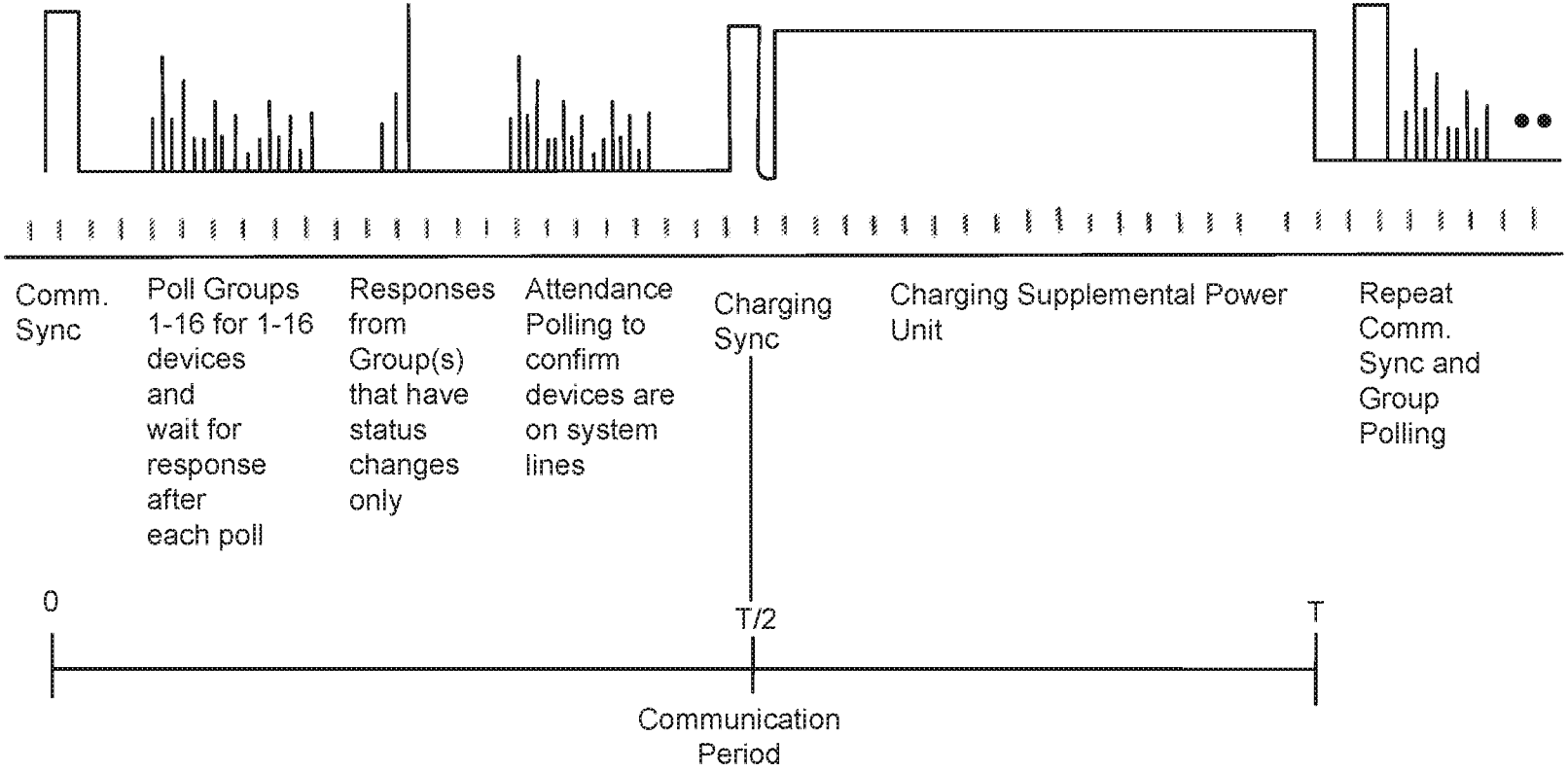
FIG. 8A is a time domain diagram showing a communication time period split between polling phase and charging phase.

FIG. 8A illustrates a time domain for a communication time period. The communication time period is represented by T which is split into two phases: a polling phase and a charging phase (i.e., time division multiplexing). During the polling phase (0 to T/2, first half of communication time period), the devices A, D, C operate in the communication mode. The polling phase is initiated when the system controller 12 sends the communication synchronization signal 138. In the illustrated example, the system controller 12 sends group polling signals 126 to check whether there are any status changes and then system controller 12 sends attendance polling signals 128 to confirm that all the devices A, D, C are on the system lines 18, 20. In addition to the attendance polls, other device specific polls may be interspersed between the group polls. During the charging phase (T/2 to T, second half of communication time period), the devices A, D, C operate in the charging mode. The charging phase is initiated when the system controller 12 sends the charging synchronization signal 136. After receiving the charging synchronization signal 136, the devices A, D, C charge their supplemental power units 32 (i.e., draw current at a high rate). After the supplemental power unit 32 is fully charged, the devices A, D, S disconnect the supplemental power device 32 and shift into the communication mode.

Since statuses of the devices A, D, S may have changed during charging phase, group polling is repeated after the devices A, D, S shift into the communication mode. The polling phase may be greater than 50% or less than 50% of the communication time period depending on the number of responses to group polling. As is typical, if most of the devices A, D, S, do not respond to the group polling, the polling phase will be less than 50%. As a result, the charging phase is extended which extends the time for charging the supplemental power device 32.

Figure 8B:
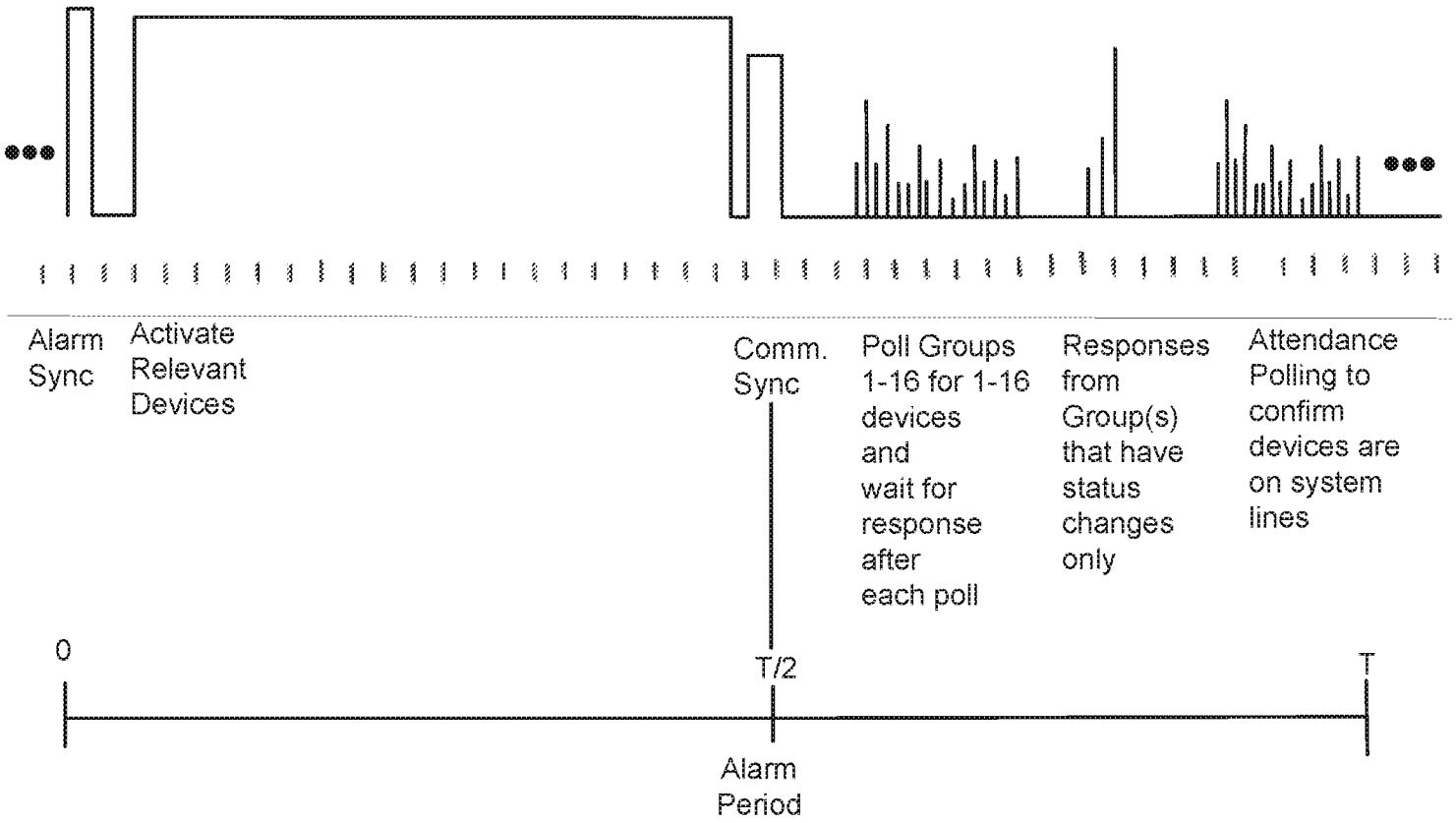
FIG. 8B is another time domain diagram showing an alarm time period split between activation phase and polling phase.

FIG. 8B illustrates a time domain for an alarm time period. The alarm time period is represented by T which is split into two phases: an activation phase and a polling phase (i.e., time division multiplexing). During the activation phase (0 to T/2, first half of alarm time period), the devices A, D, C operate in the activation mode. The activation phase is initiated when the system controller 12 sends the alarm synchronization signal 138. After receiving the charging synchronization signal 136, the devices A, D, C, use the supplemental power units 32 to provide supplemental power to their notification units 64 or their sensor units 68. The supplemental power units 32 are used to supplement power drawn from the system lines 18, 20. During the polling phase (T/2 to T, second half of alarm time period), the devices A, D, C operate in the communication mode. The polling phase is initiated when the system controller 12 sends the communication synchronization signal 138. In the illustrated example, the system controller 12 sends group polling signals 126 and then sends attendance polling signals 128 in order to continue monitoring statuses of the devices A, D, C. In addition to the attendance polls, other device specific polls may be interspersed between the group polls. The polling phase may be greater than 50% or less than 50% of the alarm time period depending on the number of responses to group polling. As is typical, if most of the devices A, D, S, do not respond to the group polling, the polling phase will be less than 50%. As a result, the activation phase is extended which extends the time for the supplemental power device 32 providing supplemental power to the notification unit 64 or the sensor unit 68.

In some examples, the power source 17 of the system controller 12 operates in different modes. In one mode, the power source 17 only provides 125 mA of current continuously on the lines 18, 20 of the system network 14. This mode would be utilized only while the devices A, D, C are in communication mode. Then, the system controller 12 would switch the power source 17 to a power supply mode and would provide 3 Amps or more of DC current. For example, a 3 A, 36V channel is used during the activation phase (i.e., 50% of the alarm time period) and a 250 mA 36V channel is used during the polling phase (i.e., 50% of the alarm time period). In one example, when the power source 17 provides 3 A at 36V during the activation phase, there is sufficient power for running over 100 notification appliance devices A (e.g., 15 Cd LED strobes) at 70% overall power conversion efficiency.

Power demand from the system lines 18, 20 also can be decreased by using high bandwidth radio frequency (RF) link functionality. For this example embodiment, multiple RF link devices reside on the system lines 18, 20 of the fire alarm system 10. Similar to the other devices A, D, C, the RF link devices are supervised by a lower bandwidth signaling line circuit (i.e., system lines 18, 20) which would provide power. The RF link devices provide higher bandwidth RF links that can be used to transmit high definition (HD) video, for example, from an HD video device when smoke is detected by an initiation device (detector device D or notification/detector combination device C). The RF link devices can include supplemental power units 32 that are used for providing the high bandwidth radio frequency (RF) link functionality.

The energy harvesting unit 50 can also be used to charge the power source 17 for a wireless fire alarm system. For fully wireless fire alarm systems, the power source 17 (also referred to as a primary battery) is often the sole source of power during the communication mode and the activation mode. In one example, the power source 17 is a rechargeable battery. As described above, the use of the energy harvesting unit 50 to charge the supplemental power units 32 provides an alternate source of power that would reduce demand on the power source 17. This harvested energy could also be used to partially recharge the power source 17 (i.e., prolong battery life of primary battery). The period of transmission from harvested energy results in slower depletion of the power source 17 and a longer interval between battery replacements.

The supplemental power unit 32 can be used to provide additional current for powering wireless devices. For example, a wireless device is connected to the system lines 18, 20 mainly for reliable power. The wireless device may or may not have a battery. In the case of no battery, the system lines 18, 20 provide supervision, through the low-bandwidth system lines 18, 20. Specifically, a wireless camera can stream HD video over wireless links (e.g., WiFi) while being powered from the low-bandwidth system lines 18, 20. The system lines 18, 20 are used for powering normal supervision of the camera and of the field of view. Power for the wireless communication or other data transmission would come from the supplemental power unit 32 (e.g., storage battery or supercapacitor). This provides a high bandwidth wireless network that is battery backed by the system lines 18, 20. The wireless camera can be used for optical detection of an intruder and provide a recording which is streamed to a server or provide a platform for video recognition of fires.

While this invention has been particularly shown and described with references to preferred embodiments thereof, it will be understood by those skilled in the art that various changes in form and details may be made therein without departing from the scope of the invention encompassed by the appended claims.

What is claimed is:

1. A device, comprising:

a notification unit for generating alert signals that indicate an alarm;

a power conditioning circuit for providing conditioned electrical power;

a power unit for providing supplemental power to the notification unit; and a device controller for charging the power unit in response to receiving a charging synchronization signal from a system controller;

a transceiver for communicating with the system controller; and a power switch, wherein the device controller directs the power switch to shift between a communication mode in which the power unit is disconnected from the power conditioning circuit and the notification unit, a charging mode in which the power unit is connected to the power conditioning circuit based on the charging synchronization signal, and an activation mode in which the notification unit is connected to the power unit.

2. The device of claim 1, further comprising a smoke/heat sensor unit or a manually activated unit for detecting a fire condition.

3. The device of claim 1, wherein the device controller monitors a state of charge of the power unit.

4. The device of claim 3, wherein the power switch is a bipolar junction transistor (BJT), a field-effect transistor (FET), an insulated-gate bipolar transistor (IGBT), or a relay.

5. The device of claim 1, wherein the device controller directs the power switch to shift between the communication mode, the charging mode, and the activation mode in response to receiving a communication synchronization signal, the charging synchronization signal, and an alarm synchronization signal, respectively.

6. The device of claim 5, wherein the device controller sends data to and receives data from the system controller when the power switch is in the communication mode.

7. The device of claim 5, wherein the power unit is charged when the power switch is in the charging mode.

8. The device of claim 5, wherein the power unit provides the supplemental power to the notification unit when the power switch is in the activation mode.

9. The device of claim 1, wherein the power unit is a supercapacitor or a rechargeable battery.

10. An alarm system, comprising:

a device for generating alert signals that indicate an alarm, wherein the device comprises a power conditioning circuit for providing conditioned electrical power, a power switch, a power unit for providing supplemental power to a notification unit and a device controller for charging the power unit; and a system controller for controlling the device;

a transceiver for communicating with the system controller wherein the device controller charges the power unit in response to receiving a charging synchronization signal from the system controller and controls the power switch to shift between a communication mode in which the power unit is disconnected from the power conditioning circuit and the notification unit, a charging mode in which the power unit is connected to the power conditioning circuit, and an activation mode in which the notification unit is connected to the power unit.

11. The system of claim 10, wherein the device is a notification appliance device or a notification/detector combination device.

12. The system of claim 10, wherein the device controller sends data to and receives data from the system controller after the device receives a communication synchronization signal from the system controller.

13. The system of claim 10, wherein the power unit provides the supplemental power to the notification unit in response to the device receiving an alarm synchronization signal from the system controller.

14. The system of claim 10, wherein the system controller is a control panel.

15. The system of claim 10, wherein the power unit is a supercapacitor or a rechargeable battery.

16. The system of claim 10, wherein the power unit is charged from power supplied by the system controller.

17. The system of claim 10, further comprising an energy harvesting unit for supplying additional power for charging the power unit.

18. The system of claim 17, wherein the energy harvesting unit is configured to harvest energy using an RF power receiver, an inductive coupling circuit, or a photovoltaic cell.

19. A method for providing supplemental power to a notification unit of a device, comprising:

a system controller sending a charging synchronization signal to the device;

a device controller of the device charging a power unit in response to the device receiving the charging synchronization signal;

the system controller sending an alarm synchronization signal to the device; and the power unit providing supplemental power to the notification unit in response to the device receiving the alarm synchronization signal, wherein when the system controller polls a group of devices for a status change and at least one device of the group of devices has the status change; then the system controller polls a byte group of devices from the group of devices;

the system controller polls a nyble group of devices from the byte group of devices that responded to the byte group polling;

the system controller polls a two bit pair of devices from the nyble group of devices that responded to the nyble group polling; and the system controller polls a device of the two bit pair of devices.

20. The method as claimed in claim 19, wherein the power unit comprises an energy harvesting unit.

* * * * *